US007155766B1

(12) United States Patent
Gilchrest, Jr. et al.

(10) Patent No.: US 7,155,766 B1
(45) Date of Patent: Jan. 2, 2007

(54) BOLSTER SYSTEM AND METHOD

(75) Inventors: Edward Gilchrest, Jr., Oxford, CT (US); George E. Riehm, New Fairfield, CT (US)

(73) Assignee: Scott Technology LLC, Oxford, CT (US)

( * ) Notice: Subject to any disclaimer, the term of this patent is extended or adjusted under 35 U.S.C. 154(b) by 9 days.

(21) Appl. No.: 11/002,604

(22) Filed: Dec. 2, 2004

(51) Int. Cl.
*A61G 7/057* (2006.01)

(52) U.S. Cl. ..... 5/732; 5/710; 5/713; 5/715

(58) Field of Classification Search ..... 5/193, 5/424, 425, 427, 731–33, 945, 710, 713–715
See application file for complete search history.

(56) References Cited

U.S. PATENT DOCUMENTS 6,079,070 A * 6/2000 Flick ..... 5/715
6,085,372 A * 7/2000 James et al. ..... 5/713
6,154,900 A * 12/2000 Shaw ..... 5/81.1 R
6,393,639 B1 * 5/2002 Ohsner ..... 5/425
6,739,001 B1 * 5/2004 Flick et al. ..... 5/425

OTHER PUBLICATIONS

TriLine Medical LLC "Arise™" Turning Low Air Loss System brochure.

* cited by examiner

*Primary Examiner*—Michael Trettel
(74) *Attorney, Agent, or Firm*—Milde & Hoffberg LLP

(57) ABSTRACT

A bolster for resisting rolling of a person off of a mattress, comprising a lateral cushion adapted to be disposed proximate and parallel to an edge of the mattress, and a tensile portion having a means for attachment to said lateral cushion, providing a distributed tensile force to resist a laterally outward displacement of the lateral cushion, the tensile force being transmitted beneath the mattress having a force vector downward and inward. Both the lateral cushion and the mattress may be inflatable, and preferably a pair of lateral cushions, interconnected by a tensile sheet below the mattress, are provided.

31 Claims, 4 Drawing Sheets

BOLSTER SYSTEM AND METHOD

BACKGROUND OF THE INVENTION

1. Field of the Invention

The present invention relates to a bolster for an air mattress.

2. Description of Background Art

A number of types of air mattresses are known, including low air loss beds, lateral rotation beds and fluidized bead beds. See, e.g. U.S. Pat. Nos. 6,694,555, 6,536,056, and 6,353,950, expressly incorporated herein by reference in their entirety. One type of known design has a series of transversely oriented bladders disposed side-by-side to form a mattress. Each bladder has a port for inflation and rapid deflation, and typically has a series of punctures on the top to provide a low flow of air out of the bladder toward the person lying on the bed. A blower control is typically provided to inflate the mattress and heat the air, and a number of other functions may be provided as well. The blower control may have a number of zones, for example head, back, buttock, and leg. Each of these zones may have independent pressure control. In addition, the blower control may be integrated with the bed frame control, to adjust for inclination, sitting posture, etc. The blower control may also provide an auxiliary output, for example to provide lateral rotation.

Pneumatic bolsters are also known. See, e.g., U.S. Pat. No. 6,668,399, expressly incorporated herein by reference in its entirety. See also, U.S. Pat. Nos. 5,421,044; 5,956,787; 6,085,372; 6,065,166; 6,154,900; 6,782,574; 6,739,001, each of which is expressly incorporated herein by reference in its entirety.

SUMMARY OF THE INVENTION

The present invention provides a pneumatic bolster for an air mattress support, wherein the mattress comprises a plurality of adjacent bladder segments disposed transversely across the bed, the bolster having a tension web portion having a set of perforating apertures through which the transverse bladder segments are inserted, and a pneumatically inflated longitudinal bolster portion, at a lateral edge of the tension web, sitting on the upper surface of the mattress, adapted to impede rolling or sliding of an occupant of the bed. Typically, the bolster is bilaterally symmetric, and thus protects both lateral edges of the mattress, but need not be so. In a symmetric form, the two tension webs are interconnected at their bottom edges which lay under the mattress.

The bolster is compatible with various mattress designs, although the size and spacing of apertures typically must correspond to the mattress bladders. Because the purpose of the tension web is to position the bolster, other suitable positioning means may be employed. For example, instead of a sheet having a series of oval apertures, this portion may be configured as a set of straps between the bolster and lower restraining portion. Likewise, instead of apertures, the bolster may be positioned by a sheet having a series of pockets for enveloping the termini of the mattress bladders.

The lower edge of the tension web (or other positioning structures) is subjected to a transverse force, toward the centerline of the mattress. In a bilaterally symmetric embodiment, this force is conveniently provided by the interconnection of positioning structures with a tensile sheet, thus pulling each other.

The longitudinal bolster portions may be attached to straps at the edge of the mattress bladders, or the bed frame, by a set of straps spaced longitudinally at the lateral edge of the bolster cushion. Thus, the bolster is subjected to tensile forces from both sides; on a lateral side by tensile forces provided through straps or other connection system to the mattress straps or the bed frame; and medially by the tensile sheet or its functional equivalent. Typically, the bolster substitutes for the normally provided bed rails, and serves similar functions.

The tension web (or positioning structures) are subject to tensile forces exerted at different heights, i.e., above the mattress laterally, and below the mattress medially, so it will typically be inclined upward and outward, forming an open-top trapezoid. The apertures are oval or elliptical, to accommodate an oval or cylindrical mattress bladder segment. To place the bolster on a mattress, the bolster may be situated on the mattress while it is deflated and flexible, with the ends of the mattress bladders inserted through the apertures.

The bolster is typically inflated to a higher pressure than the bladders of the mattress, since it is intended, over a smaller surface area, to resist shifting of the occupant of the bed. It is, however, not inflated to such a high pressure that there would be injury risk if the occupant hit or bump into it. In fact, a particular advantage of the bolster over a bedrail is that it would tend to reduce in-bed injuries associated with bedrails, both from hitting into them and getting body parts caught when they are raised and lowered.

The bolster may be provided with ingress/egress regions which have a lower nominal height above the mattress. For example, this may be achieved by constricting the bolster bladder by forming a set of longitudinal seals between opposing sides of the bladder. These ingress/egress regions may extend over about the middle fifth of the bolster. Thus, an ambulatory occupant of the bed can sit up and extend his or her feet over the constricted portion, and then exit the bed, or enter the bed in corresponding manner, without deflating the bolster.

The preferred design also includes a vent valve, which allows a rapid deflation of the bolster, for example to allow repositioning of an immobile person out of the bed without sitting up or climbing over the bolster, or to provide unimpeded access in case of emergency.

Since the bolster is inflated to a generally higher pressure than the rest of the mattress, through a common blower, the valve may include a checkvalve function, to prevent backflow when, for example, an external pressure is applied to the bolster. The valve is typically designed to allow at least 50% reduction in superambient pressure of the bolster within about 3 seconds, to allow near immediate access in case of emergency. For example, if the bolster is inflated to 2 psia, it would drop to no more than 1 psia within 3 seconds. Of course, other deflation parameters may be employed.

The bolster may be provided with a separately valved zone on a blower system, thus eliminating the need for the separate manually actuable valve. In addition, the dump function of the valve may be electronically controlled by the blower control, to allow a single actuation of a "CPR" function to deflate the entire bed structure in case of emergency.

These and other objects, features, and advantages of the present invention will become evident to those skilled in the art in light of the following brief description of the drawings and detailed description.

DETAILED DESCRIPTION OF THE PREFERRED EMBODIMENTS

Figure 1:
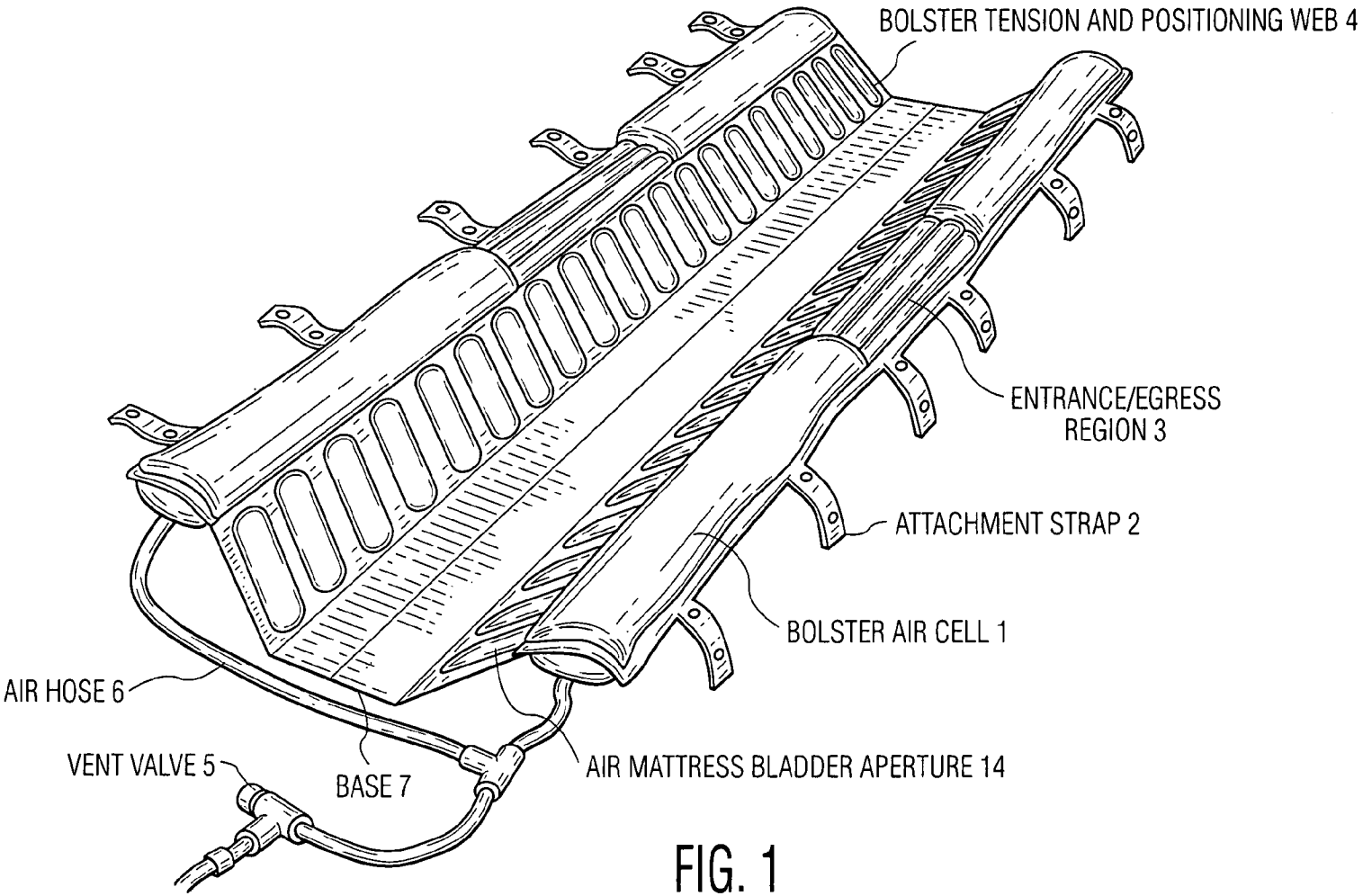
FIG. 1 shows a top perspective view of a bolster assembly in accordance with the present invention.

The mattress 10 comprises a plurality and inflatable tubular bladder elements 15 (or "cushions" or "air bags"). The individual cushion elements 15 may be arranged into a plurality of body support regions: e.g., the head region, the back region, the buttock region, and the leg/foot region. The mattress 10 is typically used for the reduction or relief of skin interface pressures for patient at risk of developing pressure ulcers or patients who already have pressure ulcers.

All air bladders, e.g., of both the mattress 10 and the bolster 1, in the preferred embodiment, comprise a polyurethane coated, impermeable, heavy duty fabric. The air bladder elements 15 of the mattress 10 preferably have a defined set of perforations, to permit a steady flow, relatively low flow of air through the fabric.

A control unit (or "controller") includes the components for inflating and controlling the mattress, and, in the case of a hospital bed, for interfacing with patient caregiver. As will be evident to those of ordinary skill in the art, such components (not shown) include a blower, a microprocessor or the equivalent, a heater, various valves and pressure sensors, manifolds, and connections, in such manner as may be desired. A separate valve and pressure sensor are provided for the bolster system. The controller has a housing adapted with adjustable hooks for mounting on the footboard or siderail of frame. The control unit connects to each one of cushions via a plurality of fluid lines (not shown) contained within a trunk line to supply the cushions with air as an inflating medium. A separate fluid line is provided for supplying the bolster with air. The fluid lines connect to their respective cushions using any suitable means such as a quick connect valve that includes a male member having a flange and a female member having a cavity about its inner surface for receiving the flange.

The controller comprises an operator input and display, processor unit, power supply, heater, temperature sensor and temperature control, blower and blower control, pressure sensors, and an air controller valve bank. The controller connects to any suitable power source such as a 120 VAC power line, preferably via a "hospital grade" outlet. The controller generates control signals for the air control valve bank to allow blower to inflate each of cushions and the bolster to appropriate pressures. The air control valve bank comprises, for example, 5 air control valves corresponding to the four zones of the mattress and the bolster. It may also comprise 4 controlled zones plus an uncontrolled output, for use in conjunction with a separate bolster valve system. While known blower controllers do not typically include a port for a bolster, they may include ports for bladders intended to position a patient along the sagittal, coronal, and or transverse planes. If available, one of these may be substituted, or an additional port provided specially for this purpose.

An integrated blower controller can be provided which not only controls the inflation of the air bolster 1, but also includes sensors and alarms to make sure a caregiver does not leave the bed in an unsafe state, i.e., bolsters uninflated and bed occupied. Other monitors and enunciators may also be provided, for example, to sense a disoriented patient trying to climb over the bolster, which would generally cause a pressure fluctuation.

Likewise, in a rapid inflate bolster configuration, the bolster may be relatively uninflated normally, and sense when the occupant is touching it or trying to roll or shift over it. In such cases, the bolster 1 could rapidly inflate, thus impeding the undesired activity, while leaving the occupant in a less confined environment otherwise. The sensor could be, for example, a pressure sensor or touch sensor on the bolster 1 bladder, or an optical interruption sensor along the length of the bolster 1.

A "CPR" button on the controller provides the user with the option of automatically and completely deflating each of mattress cushions 15 and bolster 1, and a deflate button for deflating the bolster 1 only. Alternately, the bolster 1 deflate function may be separate from the controller, by means of a valve which blocks flow of air from the controller and vents air in the bolster 1. It is also possible to control the left and right bolster bladders 1*a*, 1*b* separately, if desired. If the user presses CPR button, processor unit deactivates the blower and controls the air control valves in air control valve bank such to open the fluid lines to the atmosphere.

The side bolsters 1*a*, 1*b* according to the present invention are typically used to assist in the prevention of patients falling out of bed. The preferred embodiment of the present invention also has a mid-section entrance (ingress)/egress region 3 having a lower height that allows ingress-egress without deflating either of the side bolsters 1*a*, 1*b*. However, one or both of the bolsters 1 can also be deflated when performing nursing procedures or when the patient wishes to exit or enter the bed. The air bolsters 1 can be deflated for shipping and mattress storage.

Figure 4:
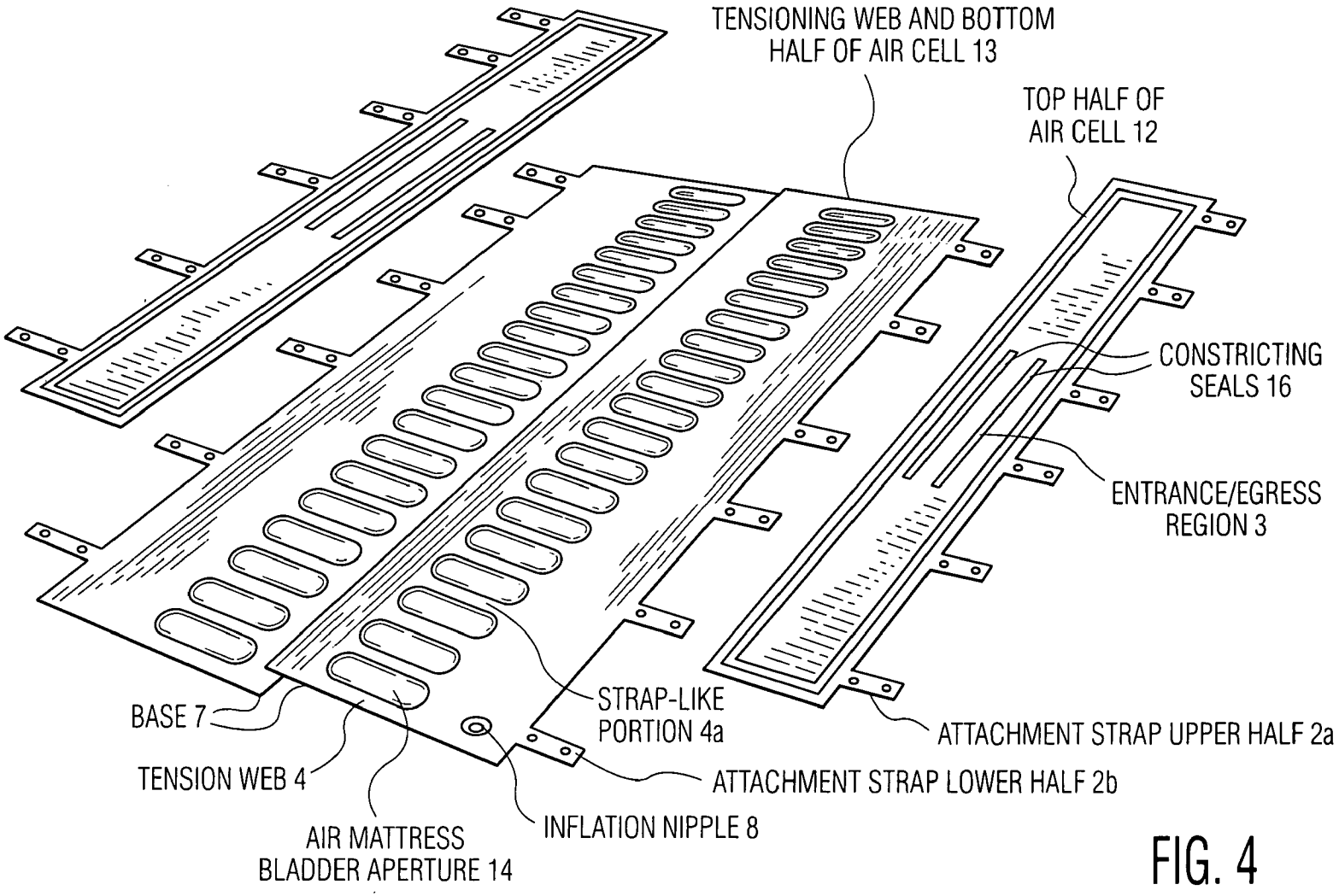
FIG. 4 shows an exploded view of the components of the bladder portion of the assembly.

As shown in FIG. 4, the bolster 1 is provided as a heat-sealed polyurethane-coated fabric pneumatic structure. The bolster bladders 1*a*, 1*b* are formed be sealing together a top half 12 and bottom half 13, to form a closed space there-between. At approximately the middle third or middle fifth of the bladder 1, the potential space may be constricted by additionally forming seals between the two sheets 12, 13, thus limiting their separation when inflated.

The bolster 1 as it is designed is manufactured by radio frequency (RF) welding sheets of urethane coated nylon fabric that have been previously die cut to the proper configuration. The material could also be nylon/vinyl, straight vinyl, or straight urethane among many other materials that are known in the art for creation of inflatables. The mattress 10 that it is used with is manufactured out of similar materials for its air cells, along with a number of other fabrics for the remainder (urethane/nylon top cover with a polyester filled quilted backing, and a 1680 denier nylon "tub" that contains the cells)

Advantageously, the top 12 and bottom 13 sheets have extensions 2*a*, 2*b* spaced along their length to form straps 2, which are provided with snaps or other attachment devices, which may include statistical hook and loop fasteners (e.g., Velcro®), magnets, hooks, or the like. These straps 2 are designed to encircle the straps 11 of the mattress, to hold the bolster 1 in place at its lateral edges.

The upper sheet 12 is shaped to provide the bolster bladder 1*a* or 1*b* and straps 2*a*. The lower sheet 13 also forms the bolster bladder 1*a* or 1*b*, and straps 2*b*, and additionally provides the tension web 4, and inflation nipple 8. The tension web 4, which in this design is contiguous with the lower sheet or base 7, but need not be, has a series of oval apertures 14 spaced and sized to accommodate the mattress bladders 15. Opposite the bolster bladder 1*a* or 1*b*, a tensile extension is provided, which may be sealed or snapped to the tension web 4 of the opposite bolster 1*b* or 1*a*, to complete the base 7. Alternately, the bolster 1 may be provided on a single side of the mattress 10, and thus may be attached to the bed frame along its midline (not shown).

Figure 2:
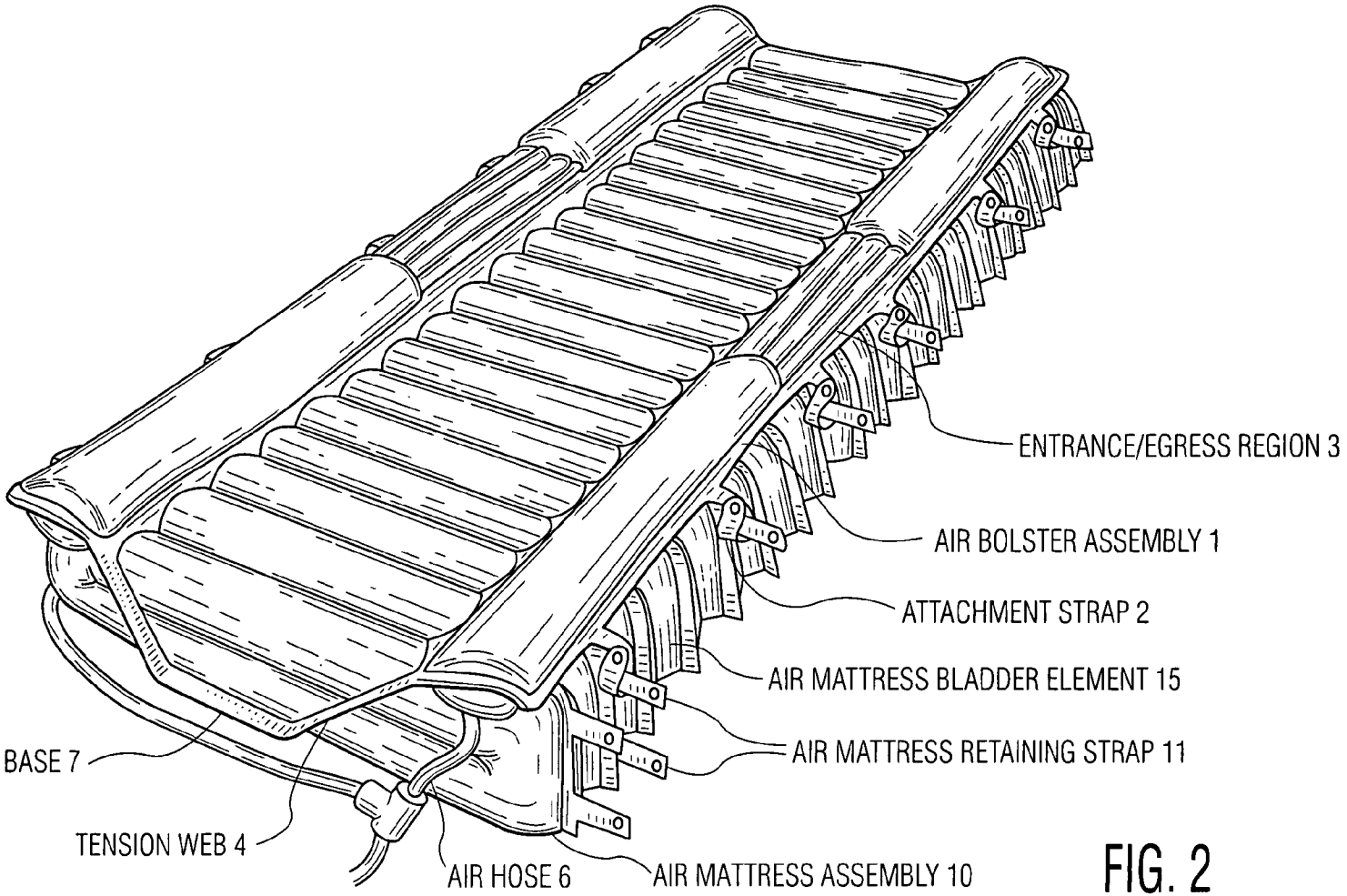
FIG. 2 shows a top perspective view of the bolster assembly of FIG. 1 installed on an air mattress.

As shown in FIG. 1, the interconnected tension webs 4 form a trapezoidal concave-upward structure, having a series of apertures 14, above which the bolster bladders 1*a*, 1*b* sit. FIG. 1 also shows the vent valve 5 and pneumatic conduit (air hose 6) to the bolster bladders 1*a*, 1*b*. The vent valve 5 permits a user to manually deflate the bolster bladders 1*a*, 1*b* and dump the air to the environment, without deactivating the blower. Thus, the bolster 1 assembly can be provided separately and independently from a blower, and may be retrofit onto existing beds. If the bolster bladders 1*a*, 1*b* are to be operated separately, the vent valve 5 would include a pair of controls for operating separate valve bodies. FIG. 2 shows the bolster 1 assembly in place on an inflated air mattress 10. In this case, the air mattress 10 has bladders 15 which are taller than wide, due to a central seal in each segment. The tension web 4 provides a strap-like portion 4*a* which extends between each pair of adjacent segments 15. The straps 2 at the lateral edge of the bolster bladder 1*a*, 1*b* are wrapped around the straps 11 of the mattress bladders 15, which in turn are attached to the bed frame (not shown), and thus held in position laterally. As can be seen, the central constricted portion 16 at the entrance/egress portion 3 of the bolster 1 has a lower height than the unconstricted remaining portions, facilitating ingress and egress of a mobile occupant.

Figure 3:
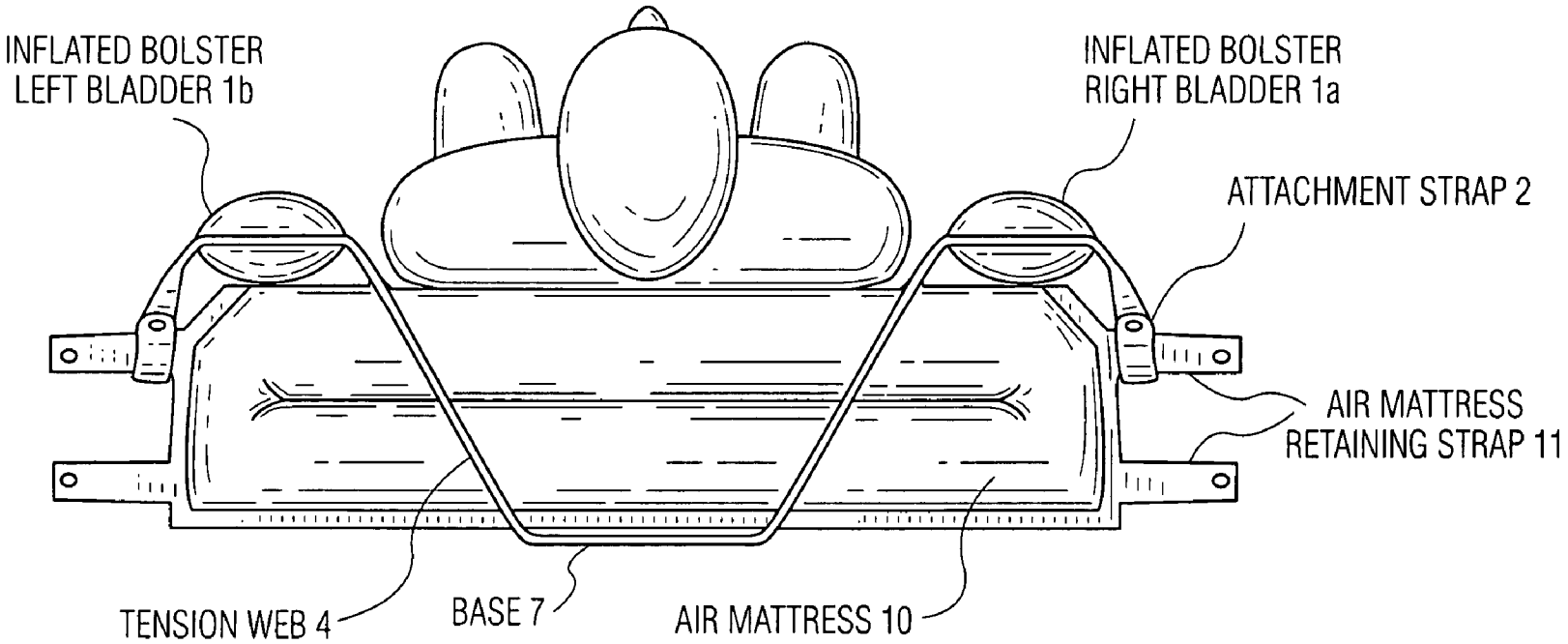
FIG. 3 shows an end view of the bolster and mattress of FIG. 2 with a person lying on the mattress.

FIG. 3 shows an occupant lying on the air mattress 10, with the bolsters 1 positioned to impede rolling and/or shifting. Since the bladder 1 structures are pneumatic, and inflated to a relatively low pressure, there is a low risk of injury if an occupant were to thrash or bump into the bolster 1, and the risk of entrapment or pinching of arms and legs in a falling bed rail is eliminated.

The bolster according to the present invention may also be used in a modified form for other types of mattresses and bolsters. For example, the pneumatic cushion may be replaced with a foam cushion, using the same attachment and positioning system, e.g., straps 2 and tension web 4, as described above. This attachment method gives strong lateral strength to the bolsters from moving on the bed without reducing an air mattress surface's pressure relief characteristics. Thus, the lateral tensile support for the bolster cushions is below the mattress, not above it, preventing a "hammocking" effect that reduces the advantages of an air mattress. That is, if the medial tensile member were provided above the mattress surface, it would produce relatively high forces against the skin of the occupant corresponding to the lateral force asserted against the bolster. This tends to reduce the advantageous independent and resilient effect of the individual mattress bladders.

Likewise, the air bolster system may be used on other types of mattresses, for example the tension web elements could periodically perforate through a foam mattress, allowing the bolsters to be laterally supported by a tension which is applied below the mattress cushion. (In order to allow installation, the strap-like portions would be separable, and for example, snap, hook or hook-and-loop fasten together.) Likewise, a foam mattress may be provided with snaps, hooks or hook-and-loop fasteners on its upper surface, displaced from the lateral edge, to allow positioning of the bolster with respect to the mattress. The lateral edge of the bolster could be attached directly to a bedframe, instead of the mattress, or to the lateral edge of the mattress. In order to reduce or balance the tensile forces on the surface of a mattress, while maintaining a sealed surface, the attachment points for the bolster may be reinforced from below with a tensile member, such as a strap or cable, internal to the mattress. Beneath the mattress, further attachment points may be provided to further transmit the forces, for example through straps to the rigid bed frame. Alternately, the tensile forces may be passed internal to the mattress, beneath the padding.

Although the present invention has been described in terms of the foregoing embodiment, such description has been for exemplary purposes only and, there will be apparent to those of ordinary skill in the art, many alternatives, equivalents, and variations of varying degrees that will fall within the scope of the present invention. That scope, accordingly, is not to be limited in any respect by the foregoing description, rather, it is defined only by the claims which follow.

What is claimed is:

1. A bolster for resisting rolling of a person off of a mattress, comprising:

a) a lateral cushion adapted to be disposed proximate and parallel to an edge of the mattress; and b) a tensile portion having a means for attachment to said lateral cushion, providing a distributed tensile force to resist a laterally outward displacement of the lateral cushion, the tensile force being transmitted beneath the mattress having a force vector downward and inward, wherein said tensile portion comprises a series of spaced straps extending through said mattress medial to said lateral cushion.

2. The bolster according to claim 1, wherein said lateral cushion is inflatable.

3. The bolster according to claim 2, further comprising a conduit for supplying a compressed gas to said lateral cushion, and a valve for selectively releasing pressure within said inflatable lateral cushion.

4. The bolster according to claim 1, wherein said mattress is inflatable.

5. The bolster according to claim 1, wherein both said lateral cushion and said mattress are inflatable, and are adapted to be inflated by a common inflation device.

6. The bolster according to claim 1, comprising a pair of lateral cushions, each disposed on respective lateral sides of the mattress.

7. The bolster according to claim 6, wherein said tensile portion of a first of said pair of lateral cushions transmits a force to a tensile portion of a second of said pair of lateral cushions.

8. The bolster according to claim 1, comprises a pair of lateral cushions, an inflation state of said pair of lateral cushions being independently controllable.

9. The bolster according to claim 1, wherein said tensile portion comprises a free end, adapted to be held in position beneath the mattress.

10. The bolster according to claim 1, wherein said lateral cushion is formed by a process of sealing to sheets together in a pattern forming a potential space therebetween.

11. The bolster according to claim 1, wherein said lateral cushion is retained at a lateral edge thereof by a plurality of straps.

12. The bolster according to claim 11, wherein said plurality of straps are adapted to encircle lateral retaining straps of an air mattress.

13. The bolster according to claim 1, wherein said lateral cushion is inflatable, in combination with an inflation control, wherein said control automatically produces an alarm in dependence on an inflation state of said inflatable lateral cushion.

14. The bolster according to claim 1, wherein said lateral cushion is inflatable, further comprising a sensor for determining a pressure in said inflatable lateral cushion.

15. The bolster according to claim 1, wherein said lateral cushion is inflatable, further comprising a valve for reducing a superambient pressure by at least about 50% within about 3 seconds.

16. A bolster for resisting rolling of a person off of a mattress, comprising:

a) a pair of lateral cushions, each disposed on respective lateral sides of the mattress the mattress, proximate and parallel to an edge of the mattress; and b) a tensile portion having a means for attachment to said lateral cushion, providing a distributed tensile force to resist a laterally outward displacement of the lateral cushion, the tensile force being transmitted beneath the mattress having a force vector downward and inward, said tensile portion of a first of said pair of lateral cushions transmits a force to a tensile portion of a second of said pair of lateral cushions, wherein said tensile portion comprises a sheet having an array of apertures, said apertures being adapted to receive therethrough a bladder segment of an inflatable mattress having transverse bladder segments.

17. The bolster according to claim 16, wherein said tensile portion comprises a series of spaced straps extending through said mattress medial to said lateral cushion.

18. The bolster according to claim 16, wherein said apertures are oval.

19. A bolster for resisting rolling of a person off of a mattress, comprising:

a) a lateral cushion adapted to be disposed proximate and parallel to an edge of the mattress; and b) a tensile portion having a means for attachment to said lateral cushion, providing a distributed tensile force to resist a laterally outward displacement of the lateral cushion, the tensile force being transmitted beneath the mattress having a force vector downward and inward, wherein said lateral cushion comprises a region having a lower height than other regions thereof, adapted for facilitating ingress and egress of a person onto and off of the mattress.

20. The bolster according to claim 19, wherein said lateral cushion is inflatable, said region having a lower height comprising a region having a region applying a tensile force between opposed portions of said lateral cushion, to restrict a potential separation therebetween.

21. A bolster for resisting rolling of a person off of a mattress, comprising:

a) a lateral cushion adapted to be disposed proximate and parallel to an edge of the mattress; and b) a tensile portion having a means for attachment to said lateral cushion, providing a distributed tensile force to resist a laterally outward displacement of the lateral cushion, the tensile force being transmitted beneath the mattress having a force vector downward and inward, wherein at least one of said lateral cushion comprises a foam cushion and the mattress comprises a padding material formed substantially of foam.

22. The bolster according to claim 21, wherein said tensile portion comprises a series of spaced straps extending through said mattress medial to said lateral cushion.

23. A method for resisting lateral movement of an occupant of a bed having a mattress, comprising:

a) providing a lateral cushion proximate and parallel to an edge of the mattress; and b) restraining the lateral cushion against an outward pushing force with a tensile force directed downward and medially through the mattress, wherein the tensile force is provided by a series of spaced straps transmitting forces through said mattress medial to said lateral cushion.

24. The method according to claim 23, wherein said lateral cushion is inflatable, and said mattress is inflatable, and are both adapted to be inflated by a common inflation device.

25. The method according to claim 23, wherein a pair of lateral cushions are provided, each disposed on respective lateral sides of the mattress, with tensile forces transmitted therebetween under the mattress.

26. The method according to claim 23, wherein the lateral cushion is inflatable, further comprising the step of rapidly deflating the inflatable lateral cushion.

27. The method according to claim 23, further comprising the step of providing a laterally outward force on the lateral cushion at a lateral edge thereof by a plurality of straps.

28. A method for resisting lateral movement of an occupant of a bed having a mattress, comprising:

a) providing a lateral cushion proximate and parallel to an edge of the mattress; and b) restraining the lateral cushion against an outward pushing force with a tensile force directed downward and medially through the mattress, wherein the tensile force is provided through a sheet having an array of apertures, the apertures being adapted to receive therethrough a bladder segment of an inflatable mattress having transversely oriented bladder segments.

29. The method according to claim 28, wherein the tensile force is provided by a series of spaced straps transmitting forces through said mattress medial to said lateral cushion.

30. A method for resisting lateral movement of an occupant of a bed having a mattress, comprising:

a) providing a lateral cushion proximate and parallel to an edge of the mattress; and b) restraining the lateral cushion against an outward pushing force with a tensile force directed downward and medially through the mattress, wherein said lateral cushion is inflatable, further comprising the step of monitoring an inflation state of the lateral cushion.

31. A bolster for resisting rolling of a person off of a mattress, comprising:

a) a lateral cushion adapted to be disposed proximate and parallel to an edge of the mattress; and b) a tensile portion having a means for attachment to said lateral cushion, providing a distributed tensile force to resist a laterally outward displacement of the lateral cushion, the tensile force being transmitted beneath the mattress having a force vector downward and inward, wherein said lateral cushion is inflatable, further comprising at least one of: an inflation control, wherein said control automatically produces an alarm in dependence on an inflation state of said inflatable lateral cushion; a sensor for determining a pressure in said inflatable lateral cushion; and a valve for reducing a superambient pressure by at least about 50% within about 3 seconds.

* * * * *